US005176212A

United States Patent [19]

Tandberg

[11] Patent Number: 5,176,212

[45] Date of Patent: Jan. 5, 1993

[54] COMBINATION DRILL BIT

[76] Inventor: Geir Tandberg, Biskop Sigurdsgate 11, N-7042 Trondheim, Norway

[21] Appl. No.: 831,448

[22] Filed: Feb. 5, 1992

[51] Int. Cl.[5] ..... E21B 10/04; E21B 10/14

[52] U.S. Cl. ..... 175/333; 175/336; 175/404

[58] Field of Search ..... 175/404, 330, 333, 393, 175/336

[56] References Cited

U.S. PATENT DOCUMENTS

| | | | |
|---|---|---|---|
| 2,034,073 | 4/1934 | Wright | 255/72 |
| 2,054,255 | 9/1936 | Howard | 175/404 |
| 2,708,105 | 5/1955 | Williams, Jr. | 175/404 |
| 3,055,443 | 9/1962 | Edwards | 175/330 |
| 3,075,592 | 1/1963 | Overly et al. | 175/333 |
| 3,077,936 | 2/1963 | Arutunoff | 175/404 |
| 3,100,544 | 8/1963 | Overly et al. | 175/404 |
| 3,424,258 | 1/1969 | Nakayama | 175/333 |
| 4,006,788 | 2/1977 | Garner | 175/330 |
| 4,440,247 | 4/1984 | Sartor | 175/393 |
| 4,538,691 | 9/1985 | Dennis | 175/404 |
| 4,694,916 | 9/1987 | Ford | 175/404 X |
| 5,016,718 | 5/1991 | Tandberg | 175/333 |

OTHER PUBLICATIONS

Maurer et al., "High-Pressure Drilling", Journal of Petroleum Technology, Jul. 1973, pp. 851-859.

*Primary Examiner*—Ramon S. Britts
*Assistant Examiner*—Frank S. Tsay
*Attorney, Agent, or Firm*—Cushman, Darby & Cushman

[57] ABSTRACT

A drill bit for drilling a hole in the ground, with cutting elements annular by cutting a core which, when it has reached a certain height, is continuously crushed by teeth on rolling cones. By combining these two processes, cutting and crushing, in this manner an improved drilling advancement is achieved as compared to separate use of these processes. The cutting elements show relatively small variations as to radial positioning, which renders it possible to find a common approximately optimal rotational speed of said elements. The core is weak and may be drilled out relatively easily by the aid of crushing, as compared to drilling pure holes. This is due to the fact that the core geometry causes a more efficient growth of fractures for each tooth penetration, and that the core, due to annular cutting, is free from radial tensions from the surrounding rock formations. In order to increase the life of the PDC cutting element, the mechanical strength of said element is improved due to the fact that the edge of the element is rounded with a small visible radius.

10 Claims, 3 Drawing Sheets 2
8
17
19
1
9
7
11
5
3
30
16
V
6
V
6
18
10
7
29
32

Fig. 2.
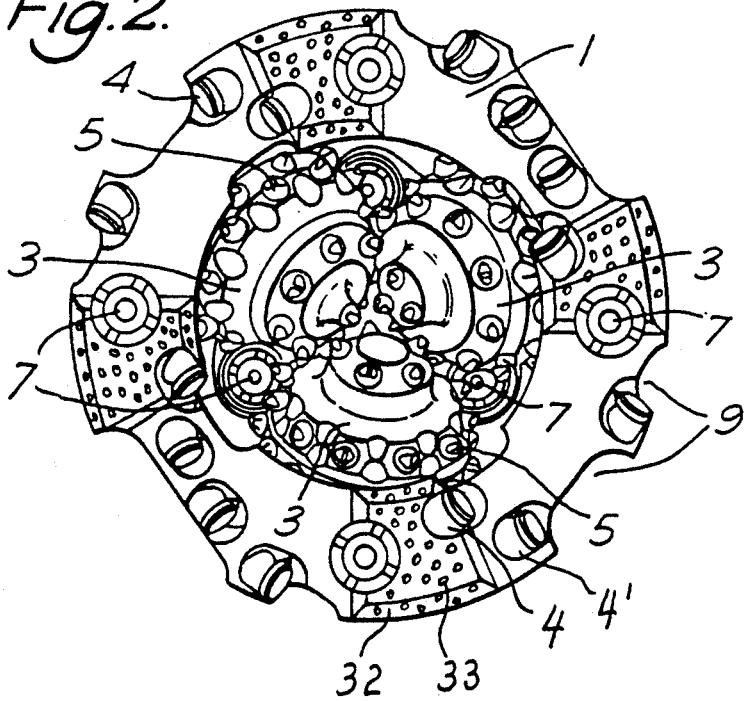
Fig. 3.a.
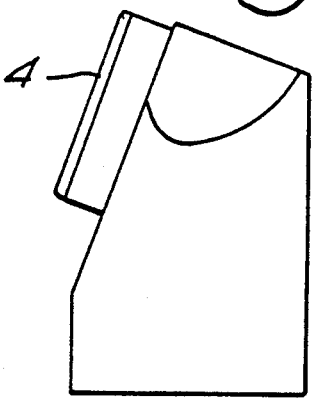
Fig. 3.b.
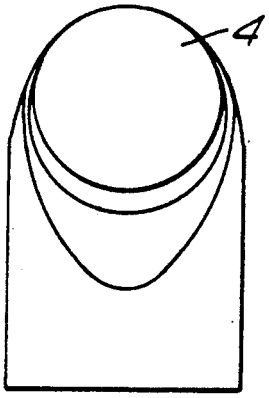

COMBINATION DRILL BIT

BACKGROUND OF THE INVENTION

The invention relates to a combination drill bit which is designed to drill holes by annular cutting and continuous core breaking.

The new combination drill bit is designed to carry out a process for drilling by annular cutting and continuous core breaking.

Experiments were carried out with jet beam cutting a core by annular cutting, which core is broken by a rock bit, c.f. Maurer, W. C. Heilhecker, J. K. and Love, W. W., "High Pressure Drilling"—Journal of Petroleum Technology, July 1973. These experiments resulted in an increase of the drilling rate by 2-3 times. The problem in utilizing a jet beam is that it requires a down-hole pumpe, which is able to produce the very high pressure necessary to enable the liquid beam to cut the formation.

Previously, PDC (polycrystalline diamond compact) cutting elements and rock bits with teeth were combined, but then mainly with the intention to limit drilling advancement in soft formations in order to avoid clogging of the cutting elements, cf. U.S. Pat. No. 4,006,788.

At present, mainly two kinds of drill bits are used, i.e. PDC drill bits and rock bits. PDC drill bits cut the formation with the aid of an edge comprised of a number of PDC cutting elements. Due to the fact that the cutting elements rotate at the same rotational speed about a common axis, cutting speed will vary from zero at the center, to a maximum outermost on the periphery of the drill bit. It is, thus, impossible to achieve an optimal cutting speed of all cutting elements at the same time.

The cuttings formed when PDC cutting elements are used, often are very small, resulting in the fact that very limited geological information can be extracted from them. PDC-bits were constructed which cut a small core for use in geological analysis, cf. U.S. Pat. No. 4,440,247. Drilling operators reported that their effect as regards acquiring larger pieces is quite low.

The edge of a present PDC cutting element is 90° and sharp. Consequently, it is comparatively weak and tends to chip.

Rock bits break up the formation, by teeth which are mounted on the rock bits being urged towards the formation by so high a force that the formation will break under and around said teeth. Due to the relatively plane face of the hole bottom, crack propagation due to each tooth penetration is of relatively small effect as regards the volume to be drilled. If the volume to be broken is acquired in the shape of an unstabilized core, the efficiency of each tooth penetration will be considerably improved.

Conventionally, the principle of annular cutting with continuous core breaking is not used, at present, for drilling holes. There are a number of patents based on this principle. According to one patent, diamonds baked into a matrix are used. This system provides for more grinding than cutting, requiring high rpm to achieve a satisfactory drilling advancement. The central rolling cones, which are used to break the core, then have to be run at too high rpm, cf. U.S. Pat. No. 3,055,443. According to another patent, edges of tungsten carbide are used, resulting in a very limited life of the drill bit due to insufficient resistance to abrasion of the edges. The last mentioned drill bit does not generate a cavity about the core before it is broken, i.e. the internal wall of the core drill bit has a stabilizing effect on the core, cf. U.S. Pat. No. 3,075,592. A third patent discloses utilizing cutting edges requiring channels/grooves in front of/-behind the edges. The channels/grooves must be large enough to permit the pieces of broken core to pass to the outside of the drill bit. The core is broken by the aid of a toothed roller which has too much scraping effect due to its geometry. This will cause the teeth of the roller to be worn down far to rapidly. Nozzles are used to flush the toothed roller and to moisten the core so as to weaken it, cf. U.S. Pat. No. 2,034,073.

U.S. Pat. No. 5,016,718 discloses a combination drill bit for continuous drilling an annular, downwardly deepening hole coaxially surrounding an upwardly projecting cylindrical core, and progressively crushing axially successive increments of the core from the upper end of the core. This known drill bit has a drill bit body with a downwardly opening internal undercut cavity, a plurality of downwardly acting cutting elements on the lower end of the drill bit body, around the cavity opening, as well as a core crushing tool disposed in the cavity, the effective diameter of the core cruching tool being greater than that of the cavity opening. Whereas this known combination drill bit displays excellent drilling performance, some problems have been observed. During drilling in plastic formations one has observed that the core crushing tool has a tendency to compress the core with the result that the upper part of the core wall will go against the cavity inner wall, thus regaining sideways support. This effect may reduce the effect of the undercuting considerably. A second observation is that the stationary abrasive core formation is pressed against the rotating cavity inner wall, thereby wearing down the inner wall, even to the possible extent that the drill bit body is cut through, resulting in a drill bit wrecking with a consequential necessity of having to fish out the separated body piece from the drill hole.

Another effect has been observed at the axially downwardly facing lower end where a plurality of downwardly acting cutting elements are mounted and where internal drilling fluid delivery channels open. This observed effect is a certain washing out of drilled out material behind the cutting elements whereby the back support for these cutting elements is reduced. This washing out for drilled out material is assumed due to the formation of fluid turbulence in the area behind the cutting elements.

It is therefore an object of the present invention to provide a combination drill bit of the general type as disclosed in said U.S. Pat. No. 5,016,718, whereby the above mentioned problems are eliminated.

SUMMARY OF THE INVENTION

With this and other objects in mind the invention comprises a generally cylindrical drill bit body having an upper end provided with means for fastening the drill bit body to means for rotating the drill bit; said drill bit body having a radially outer sidewall surface, and, coaxially therewith means defining a downwardly opening internal cavity having a radially inner sidewall surface, thereby defining an annular cylindrical portion of said drill bit body, having an annular, axially downwardly facing lower end; said cavity increasing in diameter at a level which is above said lower end, whereby said internal cavity is undercut and has an axially short band of reduced internal diameter adjacent said lower end;

a plurality of downwardly acting cutting elements mounted on said lower end of said drill bit body and distributed across the radial extent of said lower end, so that as said drill bit body is rotated, in a rock formation said cutting elements cut a downwardly deepening annular hole into the rock formation, leaving a coaxial, upwardly projecting core of rock having an upper end, said core progressively entering said cavity from below as said annular hole is deepened;

means defining internal drilling fluid delivery channels extending downwards in said drill bit body and opening into said cavity and at sites arranged for supplying drilling fluid to said cutting elements mounted on said lower end of said drill bit body;

means defining channels opening generally radially through said drill bit body between said cavity and said radially outer sidewall surface of said drill bit body;

means defining a plurality of angularly spaced external longitudinal channels on said radially outer sidewall surface of said drill body for circulating drilling fluid and cuttings upwards in said hole in said rock formation;

a core crushing tool mounted to said drill bit body and disposed in said cavity above said band of reduced internal diameter; said core crushing tool including downwardly acting rotary crushing means having an effective diameter which is greater than that of said band of reduced internal diameter;

said crushing means being mounted for rotation relative to downwardly acting cutting elements mounted on said lower end of said drill bit body;

said channels having inlet ends opening into said cavity at respective sites located axially between said core crushing tool and said band of reduced internal diameter of said drill bit body;

cutting means disposed in said cavity inner sidewall surface, at the level of said inlet openings, for cutting into the adjacent cylindrical core.

According to the ivention the said cutting elements are backed by protuberances (warts) in the zone behind a said cutting elememt, between said cutting element and an adjacent opening of the nearest drilling fluid delivery channel. A such protuberance will occupy the zone so that there will be no space where turbulence (vortices) may form.

Further objects will be apparent from the following detailed disclosure of the invention as well as from the claims.

BRIEF DESCRIPTION OF THE DRAWINGS

The invention shall now be disclosed in more detail with reference to the drawings, in which:

FIG. 2 is an end view of the drill bit;

FIG. 3 shows a PDC cutting element, in which the edge has a visible radius;

DETAILED DESCRIPTION

Figure 1:
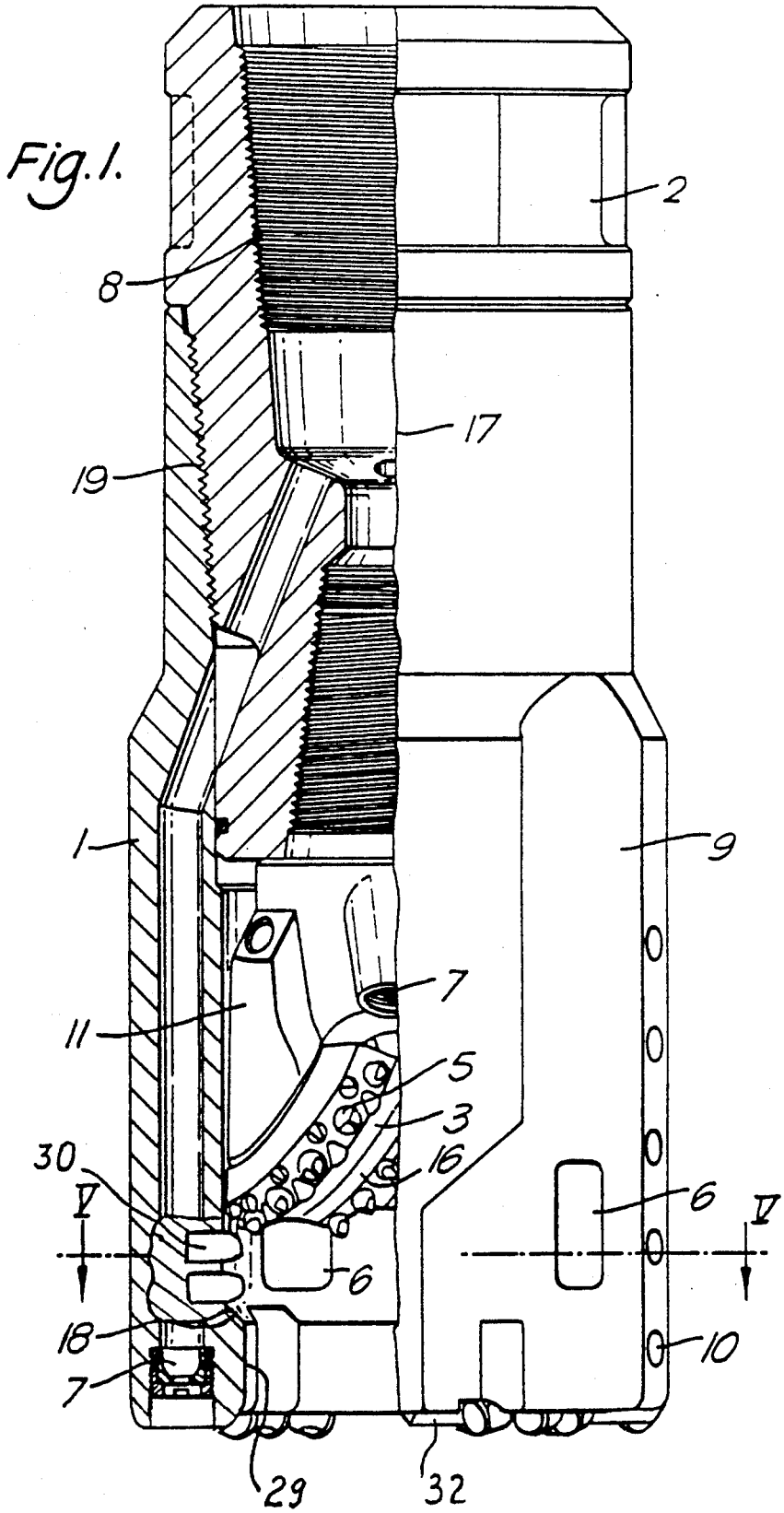
FIG. 1 shows a half longitudinal section of a drill bit according to the invention in an elevational view.

In FIGS. 1 and 2, a common drill bit 11 with rolling cones 3 is shown. Additionally, PDC cutting elements 4 are shown, the axially and radially outer edge of each of which is provided with a visible radius, as shown in more detail in FIG. 3.

Figure 4:
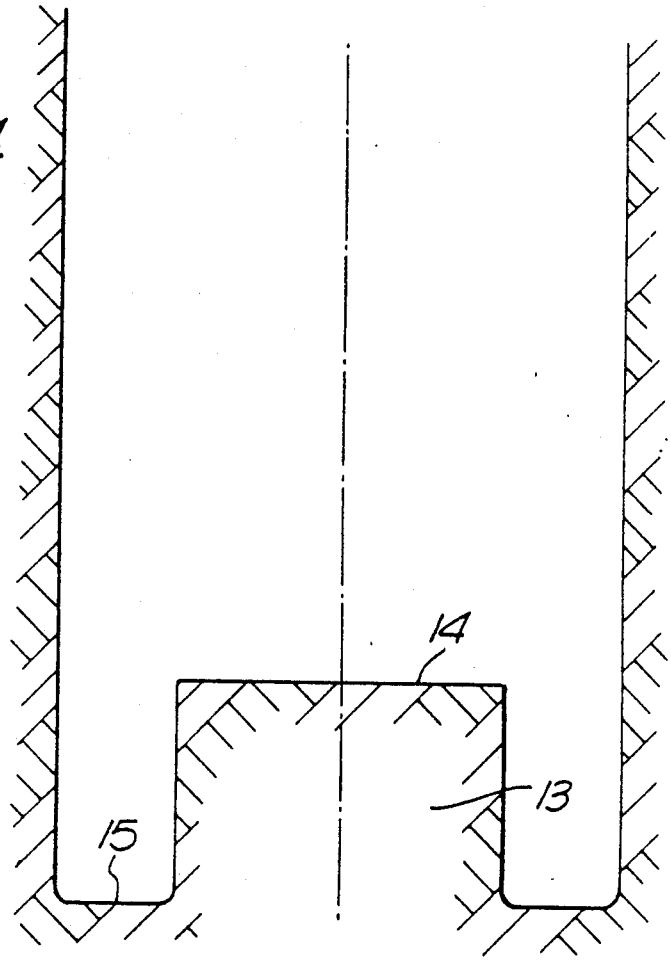
FIG. 4 shows in longitudinal section the profile of the hole bottom foemed by a drill bit according to FIGS. 1 and 2.

Cutting elements 4 are attached to a cylinder 1 and act against the annular drilling hole face 15, see FIG. 4. Rolling cones 3 with teeth 5 act, in use, against the top 14 of the cut-out core 13 to crush that top. Rolling cones 3 form part of a common rock bit 11. As shown in FIG. 1, rock bit 11 is secured in a drill fastening means 2 which is, in turn, connected with cylinder 1 with the aid of a threaded portion 19.

The drill bit rotates about central axis 17 and, at the same time, rolling cones 3 rotate about their own axis 16. Consequently, movement between rolling cones 3 and the base, which is core face 14 in this case, may be pure rolling movement. The pieces from the crushed portion of core 13 are transported with drilling fluid to the outside of the core drill bit through holes 6 in its wall. Above rolling cones 3 and at the end of the core drill bit, at the root of core 13 being drilled, nozzles 7 for drill mud open. The core drill bit and the rock bit are, as mentioned, connected by the aid of a drill bit fastening means 2, which is here also utilized for distribution of drilling fluid to nozzles 7.

Connection of the drill bit and remaining drilling equipment is achieved by threaded portion 8. Numeral 9 indicates channels for transport of drilled matter with the aid of the drilling fluid. Plugs 10 of a hard material will prevent recuction of diameter (in operation).

It will appear from FIG. 1 that end cavity 18 is undercut relative to the core diameter. A free annular space is, thus, achieved about the core to make core 13 unstabilized, which is essential in connection with subsequent crushing and removal of core material. By following the principles of the invention, a weak core is achieved, which core may be quite readily removed with the aid of crushing, as compared to drilling of conventional holes. As mentioned, this is due to the fact that the core geometry provides more efficient growth of fractures and the core, due to annular cutting, will be free of radial tensions from surrounding rock. Overall, improved drilling advancement is achieved, as compared to the annular cutting, and core breaking processes being used separately.

Figure 5:
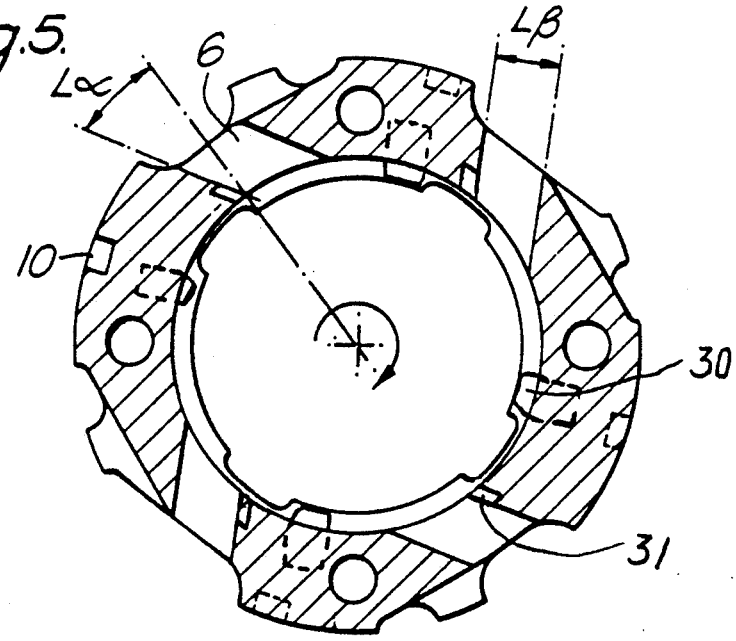
FIG. 5 is a transverse cross-sectional view taken along the line V—V i FIG. 1.

FIG. 5 shows an advantageous design of wall openings 6. The tangent line to the rear wall of wall openings 6 is each point, apart from a rounding at the inlet, is rotated against the operational direction of rotation of the drill bit by an angle $\alpha$ relative to the drill sector line through the same point, as seen from the inlet of opening 6 towards its outlet, with $\alpha = \geqq 0°$ and $\leqq 90°$. By the rear wall of the opening is meant the side of the opening which is the last to pass a fixed sector line when the drill bit is rotated in an operative direction. By sector line is meant a straight line extending normally from the axis of rotation of the drill bit. By inlet to opening 6 is meant the side from which drilled out matter flows in through opening 6. In other words, the elements 6 are channels which, while opening generally radially through the drill bit body, have respective longitudinal axes which are slanted with respect to radians of the drill bit body, so as to dispose radially inner inlet ends of these channels angularly ahead of respective radially outer ends thereof, by an angular amount in the range of ≧0° to ≦90°.

During drilling there may be a tendency for the core crushing tool, i.e. the rooling cones 3, to compress the core 13 with the result that the upper part of the core wall will go against the cavity inner wall. This effect may reduce the effect of the undercutting considerably. The pressing of the stationary core formation 13 against the rotating cavity inner wall may also result in a wearing down of the inner wall, eventually resulting in a through-cutting of the said inner wall. These undesired effects are eliminated by the cutting inserts 30 which, as disclosed in FIG. 1, is arranged in the cavity inner wall level with the holes or channels 6. The cutting inserts 30 extend into the cavity a distance corresponding to the band 29, which defines the undercutting. In other words, the inserts 30 will only cut into a compressed and thus radially expanded core 13, thereby eliminating pressure of the core against the inner wall when under compression from the rolling cones 3. The cutting inserts 30 are preferably of a material such as natural and industrial diamonds, ceramics and carbids.

The respective opening side of the channels 6 is strengthened by a cutting material 31, preferably chosen among one of industrial diamonds, artificial diamonds, ceramics and carbids, whereas the cavity inner wall preferably is toughened or provided with a wear resistant coating.

At the axially downwardly facing lower end where the cutting elements 4 are mounted, there are provided a plurality of protuberances or "warts" 32, between respective cutting elements and the adjacent openings (nozzles) 7 for drill mud. These protuberances 32 will act as backing support for the adjacent elements and they will fill out the area between a respective cutting element 4 and the nearest opening 7, thereby filling the space where vortices of drill mud otherwise would have a tendency to form.

In FIG. 2 only one cutting element respectively is shown backed by a protuberance 32, namely the radially inner one of an adjacent pair of cutting element, but the protuberance may of course extend towards and against the outer cutting element 4', thereby supporting also this cutting element.

The protuberances 32 may act as a matrix for diamond particles 33 etc. which may lengthen the operational live time of the drill bit, in that they come into function after the cutting elements 4 have been reduced by say 60 percent wear.

I claim:

1. A combination drill bit for continuously drilling an annular, downwardly deepening hole coaxially surrounding an upwardly projecting cylindrical core having an upper end, and progressively crushing axially successive increments of said core from the upper end of said core, said drill bit comprising:

a generally cylindrical drill bit body having an upper end provided with means for fastening the drill bit body to means for rotating the drill bit; said drill bit body having a radially outer sidewall surface, and, coaxially therewith means defining a downwardly opening internal cavity having a radially inner sidewall surface, thereby defining an annular cylindrical portion of said drill bit body, having an annular, axially downwardly facing lower end; said cavity increasing in diameter at a level which is above said lower end, whereby said internal cavity is undercut and has an axially short band of reduced internal diameter adjacent said lower end;

a plurality of downwardly acting cutting elements mounted on said lower end of said drill bit body and distributed across the radial extent of said lower end, so that as said drill bit body is rotated in a rock formation said cutting elements cut a downwardly deepening annular hole into the rock formation, leaving a coaxial, upwardly projecting core of rock having an upper end, said core progressively entering said cavity from below as said annular hole is deepened;

means defining internal drilling fluid delivery channels extending downwards in said drill bit body and opening into said cavity and at sites arranged for supplying drilling fluid to said cutting elements mounted on said lower end of said drill bit body;

means defining channels opening generally radially through said drill bit body between said cavity and said radially outer sidewall surface of said drill bit body;

means defining a plurality of angularly spaced external longitudinal channels on said radially outer sidewall surface of said drill bit body for circulating drilling fluid and cuttings upwards in said hole in said rock formation;

a core crushing tool mounted to said drill bit body and disposed in said cavity above said band of reduced internal diameter; said core crushing tool including downwardly acting rotary crushing means having an effective diameter which is greater than that of said band of reduced internal diameter;

said crushing means being mounted for rotation relative to downwardly acting cutting elements mounted on said lower end of said drill bit body;

said channels having inlet ends opening into said cavity at respective sites located axially between said core crushing tool and said band of reduced internal diameter of said drill bit body;

cutting means disposed in said cavity inner side wall surface, at the level of said inlet openings, for cutting into the adjacent cylindrical core.

2. A combination drill bit for continuously drilling an annular, downwardly deepening hole coaxially surrounding an upwardly projecting cylindrical core having an upper end, and progressively crushing axially successive increments of said core from the upper end of said core, said drill bit comprising:

a generally cylindrical drill bit body having an upper end provided with means for fastening the drill bit body to means for rotating the drill bit; said drill bit body having a radially outer sidewall surface, and, coaxially therewith means defining a downwardly opening internal cavity having a radially inner sidewall surface, thereby defining an annular cylindrical portion of said drill bit body, having an annular, axially downwardly facing lower end; said cavity increasing in diameter at a level which is above said lower end, whereby said internal cavity is undercut and has an axially short band of reduced internal diameter adjacent said lower end;

a plurality of downwardly acting cutting elements mounted on said lower end of said drill bit body and distributed across the radial extent of said lower end, so that as said drill bit body is rotated in a rock formation said cutting elements cut a downwardly deepening annular hole into the rock formation, leaving a coaxial, upwardly projecting core of rock having an upper end, said core progressively entering said cavity from below as said annular hole is deepened;

means defining internal drilling fluid delivery channels extending downwards in said drill bit body and opening into said cavity and at sites arranged for supplying drilling fluid to said cutting elements mounted on said lower end of said drill bit body;

means defining channels opening generally radially through said drill bit body between said cavity and said radially outer sidewall surface of said drill bit body;

means defining a plurality of angularly spaced external longitudinal channels on said radially outer sidewall surface of said drill bit body for circulating drilling fluid and cuttings upwards in said hole in said rock formation;

a core crushing tool mounted to said drill bit body and disposed in said cavity above said band of reduced internal diameter; said core crushing tool including downwardly acting rotary crushing means having an effective diameter which is greater than that of said band of reduced internal diameter;

said crushing means being mounted for rotation relative to downwardly acting cutting elements mounted on said lower end of said drill bit body;

said channels having inlet ends opening into said cavity at respective sites located axially between said core crushing tool and said band of reduced internal diameter of said drill bit body;

cutting means disposed in said cavity inner side wall surface, at the level of said inlet openings, for cutting into the cylindrical core, said cutting means being made of at least one of industrial diamonds, artificial diamonds, ceramics or carbids.

3. A combination drill bit for continuously drilling an annular, downwardly deepening hole coaxially surrounding an upwardly projecting cylindrical core having an upper end, and progressively crushing axially successive increments of said core from the upper end of said core, said drill bit comprising:

a generally cylindrical drill bit body having an upper end provided with means for fastening the drill bit body to means for rotating the drill bit; said drill bit body having a radially outer sidewall surface, and, coaxially therewith means defining a downwardly opening internal cavity having a radially inner sidewall surface, thereby defining an annular cylindrical portion of said drill bit body, having an annular, axially downwardly facing lower end; said cavity increasing in diameter at a level which is above said lower end, whereby said internal cavity is undercut and has an axially short band of reduced internal diameter adjacent said lower end;

a plurality of downwardly acting cutting elements mounted on said lower end of said drill bit body and distributed across the radial extent of said lower end, so that as said drill bit body is rotated in a rock formation said cutting elements cut a downwardly deepening annular hole into the rock formation, leaving a coaxial, upwardly projecting core of rock having an upper end, said core progressively entering said cavity from below as said annular hole is deepened; said cutting elements being made of at least one of polycrystalline diamond compact and ceramic material;

means defining internal drilling fluid delivery channels extending downwards in said drill bit body and opening into said cavity and at sites arranged for supplying drilling fluid to said cutting elements mounted on said lower end of said drill bit body;

means defining channels opening generally radially through said drill bit body between said cavity and said radially outer sidewall surface of said drill bit body;

means defining a plurality of angularly spaced external longitudinal channels on said radially outer sidewall surface of said drill bit body for circulating drilling fluid and cuttings upwards in said hole in said rock formation;

a core crushing tool mounted to said drill bit body and disposed in said cavity above said band of reduced internal diameter; said core crushing tool including downwardly acting rotary crushing means having an effective diameter which is greater than that of said band of reduced internal diameter;

said crushing means being mounted for rotation relative to downwardly acting cutting elements mounted on said lower end of said drill bit body;

said channels having inlet ends opening into said cavity at respective sites located axially between said core crushing tool and said band of reduced internal diameter of said drill bit body;

the distance axially of said drill bit body between said core crushing tool and said downwardly acting cutting elements on said lower end of said drill bit body being such as to provide, in use, that said core has an axial length which is between 0.5 and 2 times the outer diameter of said core; and the inner diameter of said band of reduced internal diameter and the outer diameter of said radially outer sidewall surface of said drill bit body being such as to provide, in use, that said core has an outer diameter which is at least 0.4 times the outer diameter of said hole in said rock formation; cutting means disposed in said cavity inner sidewall surface, at the level of said inlet openings, for cutting into the cylindrical core.

4. A combination drill bit for continuously drilling an annular, downwardly deepening hole coaxially surrounding an upwardly projecting cylindrical core having an upper end, and progressively crushing axially successive increments of said core from the upper end of said core, said drill bit comprising:

a generally cylindrical drill bit body having an upper end provided with means for fastening the drill bit body to means for rotating the drill bit; said drill bit body having a radially outer sidewall surface, and, coaxially therewith means defining a downwardly opening internal cavity having a radially inner sidewall surface, thereby defining an annular cylindrical portion of said drill bit body, having an annular, axially downwardly facing lower end; said cavity increasing in diameter at a level which is above said lower end, whereby said internal cavity is undercut and has an axially short band of reduced internal diameter adjacent said lower end;

a plurality of downwardly acting cutting elements mounted on said lower end of said drill bit body and distributed across the radial extent of said lower end, so that as said drill bit body is rotated in a rock formation said cutting elements cut a downwardly deepening annular hole into the rock formation, leaving a coaxial, upwardly projecting core of rock having an upper end, said core progressively entering said cavity from below as said annular hole is deepened; said cutting elements being made of at least one of polycrystalline diamond compact and ceramic material;

means defining internal drilling fluid delivery channels extending downwards in said drill bit body and opening into said cavity and at sites arranged for supplying drilling fluid to said cutting elements mounted on said lower end of said drill bit body;

means defining channels opening generally radially through said drill bit body between said cavity and said radially outer sidewall surface of said drill bit body;

means defining a plurality of angularly spaced external longitudinal channels on said radially outer sidewall surface of said drill bit body for circulating drilling fluid and cuttings upwards in said hole in said rock formation;

a core crushing tool mounted to said drill bit body and disposed in said cavity above said band of reduced internal diameter; said core crushing tool including downwardly acting rotary crushing means having an effective diameter which is greater than that of said band of reduced internal diameter;

said crushing means being mounted for rotation relative to downwardly acting cutting elements mounted on said lower end of said drill bit body;

said channels having inlet ends opening into said cavity at respective sites located axially between said core crushing tool and said band of reduced internal diameter of said drill bit body;

the distance axially of said drill bit body between said core crushing tool and said downwardly acting cutting elements on said lower end of said drill bit body being such as to provide, in use, that said core has an axial length which is between 0.5 and 2 times the outer diameter of said core; and the inner diameter of said band of reduced internal diameter and the outer diameter of said radially outer sidewall surface of said drill bit body being such as to provide, in use, that said core has an outer diameter which is at least 0.4 times the outer diameter of said hole in said rock formation; cutting means disposed in said cavity inner sidewall surface, at the level of said inlet openings, for cutting into the cylindrical core, said cutting means being made of at least one of industrial diamonds, artificial diamonds, ceramics or carbids.

5. A combination drill bit for continuously drilling an annular, downwardly deepening hole coaxially surrounding an upwardly projecting cylindrical core having an upper end, and progressively crushing axially successive increments of said core from the upper end of said core, said drill bit comprising:

a generally cylindrical drill bit body having an upper end provided with means for fastening the drill bit body to means for rotating the drill bit; said drill bit body having a radially outer sidewall surface, and, coaxially therewith means defining a downwardly opening internal cavity having a radially inner sidewall surface, thereby defining an annular cylindrical portion of said drill bit body, having an annular, axially downwardly facing lower end; said cavity increasing in diameter at a level which is above said lower end, whereby said internal cavity is undercut and has an axially short band of reduced internal diameter adjacent said lower end;

a plurality of downwardly acting cutting elements mounted on said lower end of said drill bit body and distributed across the radial extent of said lower end, so that as said drill bit body is rotated in a rock formation said cutting elements cut a downwardly deepening annular hole into the rock formation, leaving a coaxial, upwardly projecting core of rock having an upper end, said core progressively entering said cavity from below as said annular hole is deepened;

means defining internal drilling fluid delivery channels extending downwards in said drill bit body and opening into said cavity and at sites arranged for supplying drilling fluid to said cutting elements mounted on said lower end of said drill bit body;

means defining channels opening generally radially through said drill bit body between said cavity and said radially outer sidewall surface of said drill bit body;

means defining a plurality of angularly spaced external longitudinal channels on said radially outer sidewall surface of said drill bit body for circulating drilling fluid and cuttings upwards in said hole in said rock formation;

a core crushing tool mounted to said drill bit body and disposed in said cavity above said band of reduced internal diameter; said core crushing tool including downwardly acting rotary crushing means having an effective diameter which is greater than that of said band of reduced internal diameter;

said crushing means being mounted for rotation relative to downwardly acting cutting elements mounted on said lower end of said drill bit body;

said channels having inlet ends opening into said cavity at respective sites located axially between said core crushing tool and said band of reduced internal diameter of said drill bit body; each of said inlet ends having an opening side pointing in the rotational direction of the drill bit, said side being strengthened by a cutting material;

cutting means disposed in said cavity inner sidewall surface, at the level of said inlet openings, for cutting into the cylindrical core.

6. A combination drill bit for continuously drilling an annular, downwardly deepening hole coaxially surrounding an upwardly projecting cylindrical core having an upper end, and progressively crushing axially successive increments of said core from the upper end of said core, said drill bit comprising:

a generally cylindrical drill bit body having an upper end provided with means for fastening the drill bit body to means for rotating the drill bit; said drill bit body having a radially outer sidewall surface, and, coaxially therewith means defining a downwardly opening internal cavity having a radially inner sidewall surface, thereby defining an annular cylindrical portion of said drill bit body, having an annular, axially downwardly facing lower end; said cavity increasing in diameter at a level which is above said lower end, whereby said internal cavity is undercut and has an axially short band of reduced internal diameter adjacent said lower end;

a plurality of downwardly acting cutting elements mounted on said lower end of said drill bit body and distributed across the radial extent of said lower end, so that as said drill bit body is rotated in a rock formation said cutting elements cut a downwardly deepening annular hole into the rock formation, leaving a coaxial, upwardly projecting core of rock having an upper end, said core progressively entering said cavity from below as said annular hole is deepened;

means defining internal drilling fluid delivery channels extending downwards in said drill bit body and opening into said cavity and at sites arranged for supplying drilling fluid to said cutting elements mounted on said lower end of said drill bit body;

means defining channels opening generally radially through said drill bit body between said cavity and said radially outer sidewall surface of said drill bit body;

means defining a plurality of angularly spaced external longitudinal channels on said radially outer sidewall surface of said drill bit body for circulating drilling fluid and cuttings upwards in said hole in said rock formation;

a core crushing tool mounted to said drill bit body and disposed in said cavity above said band of reduced internal diameter; said core crushing tool including downwardly acting rotary crushing means having an effective diameter which is greater than that of said band of reduced internal diameter;

said crushing means being mounted for rotation relative to downwardly acting cutting elements mounted on said lower end of said drill bit body;

said channels having inlet ends opening into said cavity at respective sites located axially between said core crushing tool and said band of reduced internal diameter of said drill bit body; each of said inlet ends having an opening side pointing in the rotational direction of the drill bit, said side being strengthened by a cutting material of at least one of industrial diamonds, artificial diamonds, ceramics and carbids;

cutting means disposed in said cavity inner sidewall surface, at the level of said inlet openings, for cutting into the cylindrical core.

7. A combination drill bit for continuously drilling an annular, downwardly deepening hole coaxially surrounding an upwardly projecting cylindrical core having an upper end, and progressively crushing axially successive increments of said core from the upper end of said core, said drill bit comprising:

a generally cylindrical drill bit body having an upper end provided with means for fastening the drill bit body to means for rotating the drill bit; said drill bit body having a radially outer sidewall surface, and, coaxially therewith means defining a downwardly opening internal cavity having a radially inner sidewall surface, thereby defining an annular cylindrical portion of said drill bit body, having an annular, axially downwardly facing lower end; said cavity increasing in diameter at a level which is above said lower end, whereby said internal cavity is undercut and has an axially short band of reduced internal diameter adjacent said lower end;

a plurality of downwardly acting cutting elements mounted on said lower end of said drill bit body and distributed across the radial extent of said lower end, so that as said drill bit body is rotated in a rock formation said cutting elements cut a downwardly deepening annular hole into the rock formation, leaving a coaxial, upwardly projecting core of rock having an upper end, said core progressively entering said cavity from below as said annular hole is deepened;

means defining internal drilling fluid delivery channels extending downwards in said drill bit body and opening into said cavity and at sites arranged for supplying drilling fluid to said cutting elements mounted on said lower end of said drill bit body;

means difining channels opening generally radially through said drill bit body between said cavity and said radially outer sidewall surface of said drill bit body;

means defining a plurality of angularly spaced external longitudinal channels on said radially outer sidewall surface of said drill bit body for circulating drilling fluid and cuttings upwards in said hole in said rock formation;

core crushing tool mounted to said drill bit body and disposed in said cavity above said band of reduced internal diameter; said core crushing tool including downwardly acting rotary crushing means having an effective diameter which is greater than that of said band of reduced internal diameter;

said crushing means being mounted for rotation relative to downwardly acting cutting elements mounted on said lower end of said drill bit body;

said channels having inlet ends opening into said cavity at respective sites located axially between said core crushing tool and said band of reduced internal diameter of said drill bit body; each of said inlet ends having an opening side pointing in the rotational direction of the drill bit, said opening side being strengthened by a cutting material;

the distance axially of said drill bit body between said core crushing tool and said downwardly acting cutting elements on said lower end of said drill bit body being such as to provide, in use, that said core has an axial length which is between 0.5 and 2 times the outer diameter of said core; and the inner diameter of said band of reduced internal diameter and the outer diameter of said radially outer sidewall surface of said drill bit body being such as to provide, in use, that said core has an outer diameter which is at least 0.4 times the outer diameter of said hole in said rock formation; cutting means disposed in said cavity inner sidewall surface, at the level of said inlet openings, for cutting into the cylindrical core.

8. A combination drill bit for continuously drilling an annular, downwardly deepening hole coaxially surrounding an upwardly projecting cylindrical core having an upper end, and progressively crushing axially successive increments of said core from the upper end of said core, said drill bit comprising:

a generally cylindrical drill bit body having an upper end provided with means for fastening the drill bit body to means for rotating the drill bit; said drill bit body having a radially outer sidewall surface, and, coaxially therewith means defining a downwardly opening internal cavity having a radially inner sidewall surface, thereby defining an annular cylindrical portion of said drill bit body, having an annular, axially downwardly facing lower end; said cavity increasing in diameter at a level which is above said lower end, whereby said internal cavity is undercut and has an axially short band of reduced internal diameter adjacent said lower end;

a plurality of downwardly acting cutting elements mounted on said lower end of said drill bit body and distributed across the radial extent of said lower end, so that as said drill bit body is rotated in a rock formation said cutting elements cut a downwardly deepening annular hole into the rock formation, leavin a coaxial, upwardly projecting core of rock having an upper end, said core progressively entering said cavity from below as said annular hole is deepened; said cutting elements being made of at least one of polycrystalline diamond compact and ceramic material;

means defining internal drilling fluid delivery channels extending downwards in said drill bit body and opening into said cavity and at sites arranged for supplying drilling fluid to said cutting elements mounted on said lower end of said drill bit body;

means defining channels opening generally radially through said drill bit body between said cavity and said radially outer sidewall surface of said drill bit body;

means defining a plurality of angularly spaced external longitudinal channels on said radially outer sidewall surface of said drill bit body for circulating drilling fluid and cuttings upwards in said hole in said rock formation;

a core crushing tool mounted to said drill bit body and disposed in said cavity above said band of reduced internal diameter; said core crushing tool including downwardly acting rotary crushing means having an effective diameter which is greater than that of said band of reduced internal diameter;

said crushing means being mounted for rotation relative to downwardly acting cutting elements mounted on said lower end of said drill bit body;

said channels having inlet ends opening into said cavity at respective sites located axially between said core crushing tool and said band of reduced internal diameter of said drill bit body; each of said inlet ends having an opening side pointing in the rotational direction of the drill bit being strengthened by a cutting material;

the distance axially of said drill bit body between said core crushing tool and said downwardly acting cutting elements on said lower end of said drill bit body being such as to provide, in use, that said core has an axial length which is between 0.5 and 2 times the outer diameter of said core; and the inner diameter of said band of reduced internal diameter and the outer diameter of said radially outer sidewall surface of said drill bit body being such as to provide, in use, that said core has an outer diameter which is at least 0.4 times the outer diameter of said hole in said rock formation; cutting means disposed in said cavity inner sidewall surface, at the level of said inlet openings, for cutting into the cylindrical core.

9. A combination drill bit for continuously drilling an annular, downwardly deepening hole coaxially surrounding an upwardly projecting cylindrical core having an upper end, and progressively crushing axially successive increments of said core from the upper end of said core, said drill bit comprising:

a generally cylindrical drill bit body having an upper end provided with means for fastening the drill bit body to means for rotating the drill bit; said drill bit body having a radially outer sidewall surface, and, coaxially therewith means defining a downwardly opening internal cavity having a radially inner sidewall surface, thereby defining an annular cylindrical portion of said drill bit body, having an annular, axially downwardly facing lower end; said cavity increasing in diameter at a level which is above said lower end, whereby said internal cavity is undercut and has an axially short band of reduced internal diameter adjacent said lower end;

a plurality of downwardly acting cutting elements mounted on said lower end of said drill bit body and distributed across the radial extent of said lower end, so that as said drill bit body is rotated in a rock formation said cutting elements cut a downwardly deepening annular hole into the rock formation, leaving a coaxial, upwardly projecting core of rock having an upper end, said core progressively entering said cavity from below as said annular hole is deepened;

means defining internal drilling fluid delivery channels extending downwards in said drill bit body and opening into said cavity and at sites arranged for supplying drilling fluid to said cutting elements mounted on said lower end of said drill bit body;

means defining channels opening generally radially through said drill bit body between said cavity and said radially outer sidewall surface of said drill bit body;

means defining a plurality of angularly spaced external longitudinal channels on said radially outer sidewall surface of said drill bit body for circulating drilling fluid and cuttings upwards in said hole in said rock formation;

a core crushing tool mounted to said drill bit body and disposed in said cavity above said band of reduced internal diameter; said core crushing tool including downwardly acting rotary crushing means having an effective diameter which is greater than that of said band of reduced internal diameter;

said crushing means being mounted for rotation relative to downwardly acting cutting elements mounted on said lower end of said drill bit body;

said channels having inlet ends opening into said cavity at respective sites located axially between said core crushing tool and said band of reduced internal diameter of said drill bit body; said channels opening generally radially through said bit body having respective longitudinal axes which dispose radially inner inlet ends of respective ones of said channels angularly ahead of radially outer outlet ends thereof by an angular amount in the range of $\geqq 0°$ to $\leqq 90°$;

cutting means disposed in said cavity inner saidewall surface, at the level of said inlet openings, for cutting into the adjacent cylindrical core.

10. A combination drill bit for continuously drilling an annular, downwardly deepening hole coaxially surrounding an upwardly projecting cylindrical core having an upper end, and progressively crushing axially successive increments of said core from the upper end of said core, said drill bit comprising:

a generally cylindrical drill bit body having an upper end provided with means for fastening the drill bit body to means for rotating the drill bit; said drill bit body having a radially outer sidewall surface, an, coaxially therewith means defining a downwardly opening internal cavity having a radially inner sidewall surface, thereby defining an annular cylindrical portion of said drill bit body, having an annular, axially downwardly facing lower end; said cavity increasing in diameter at a level which is above said lower end, whereby said internal cavity is undercut and has an axially short band of reduced internal diameter adjacent said lower end;

a plurality of downwardly acting cutting elements mounted on said lower end of said drill bit body and distributed across the radial extent of said lower end, so that as said drill bit body is rotated in a rock formation said cutting elements cut a downwardly deepening annular hole into the rock formation, leaving a coaxial, upwardly projecting core of rock having an upper end, said core progressively entering said cavity from below as said annular hole is deepened;

means defining internal drilling fluid delivery channels extending downwards in said drill bit body and opening into said cavity and at sites arranged for supplying drilling fluid to said cutting elements mounted on said lower end of said drill bit body;

means defining channels opening generally radially through said drill bit body between said cavity and said radially outer sidewall surface of said drill bit body;

means defining a plurality of angularly spaced external longitudinal channels on said radially outer sidewall surface of said drill bit body for circulating drilling fluid and cuttings upwards in said hole in said rock formation;

a core crushing tool mounted to said drill bit body and disposed in said cavity above said band of reduced internal diameter; said core crushing tool including downwardly acting rotary crushing means having an effective diameter which is greater than that of said band of reduced internal diameter;

said crushing means being mounted for rotation relative to downwardly acting cutting elements mounted on said lower end of said drill bit body;

said channels having inlet ends opening into said cavity at respective sites located axially between said core crushing tool and said band of reduced internal diameter of said drill bit body;

cutting means disposed in said cavity inner side wall surface, at the level of said inlet openings, for cutting into the adjacent cylindrical core, protuberance means between a said cutting element and an adjacent opening of a said drilling fluid delivery channel, respectively.

* * * * *